United States Patent [19]

Zandel

[11] Patent Number: 4,688,417

[45] Date of Patent: Aug. 25, 1987

[54] APPARATUS FOR EASY REMOVAL OF LARGE HYDRAULIC CYLINDERS FROM PRESSES OF PULL-DOWN DESIGN

[75] Inventor: Adam Zandel, Forest Hills, N.Y.

[73] Assignee: Press Technology Corporation, White Plains, N.Y.

[21] Appl. No.: 843,018

[22] Filed: Mar. 24, 1986

[51] Int. Cl.[4] ..... B21J 13/08

[52] U.S. Cl. ..... 72/446; 72/455; 72/453.09; 100/214; 248/637

[58] Field of Search ..... 52/749; 72/446, 448, 72/455, 456, 453.09, 453.11, 417, 419, 444; 100/214, 276, 269 R; 248/678, 679, 637

[56] References Cited

U.S. PATENT DOCUMENTS

| | | | |
|---|---|---|---|
| 545,758 | 9/1895 | Aiken | 72/455 |
| 1,999,249 | 4/1935 | Meyercord et al. | 100/214 |
| 3,931,728 | 1/1976 | Trolle | 72/455 |
| 3,969,921 | 7/1976 | Jonsson et al. | 72/453.06 |

FOREIGN PATENT DOCUMENTS

| | | | |
|---|---|---|---|
| 1055993 | 1/1967 | United Kingdom | 100/214 |

*Primary Examiner*—Robert L. Spruill
*Assistant Examiner*—David B. Jones
*Attorney, Agent, or Firm*—Ostrolenk, Faber, Gerb & Soffen

[57] ABSTRACT

A pull-down type forging press is provided with a horizontally extending tunnel in its foundation pit through which the large main cylinders which generate the forging press forces can be removed from the press. A vertical shaft in communication with the horizontal tunnel and a suitable crane located in the main building containing the press enable the main cylinders to be lifted from the foundation pit for maintenance or servicing. Guide rails on the floor of the tunnel and hydraulic jacks braced against the walls of the tunnel or other stationary structures in the foundation pit serve to push the cylinders under the vertical shaft over a straight course and also return them back into the proper position in the press after the servicing is completed.

6 Claims, 2 Drawing Figures

APPARATUS FOR EASY REMOVAL OF LARGE HYDRAULIC CYLINDERS FROM PRESSES OF PULL-DOWN DESIGN

BACKGROUND OF THE INVENTION

This invention relates to large forging presses of the pull-down type and, particularly, to an arrangement of such forging press by which removal of the large hydraulic cylinders from the foundation pit of the press is facilitated.

The present invention is closely related to the subject matter described in patent application Ser. No. 821,790 entitled "A FORGING PRESS WITH ADJUSTABLE DAYLIGHT AND WITH YOKE DESIGN FOR ATTACHING TIE-RODS TO CROSSHEADS" which is commonly assigned with the present application. The subject matter thereof is incorporated herein by reference.

Forging presses are used for shaping a metallic workpiece into an end product of desired shape by pressing said workpiece between two facing die halves to give the workpiece an intended shape.

Various types of forging presses are known. The concept of the present invention is however most suitable for a pull-down forging press which includes a very large steel frame surrounding a stationary bridge, the frame being movable up and down relative to the bridge. The frame has a top which extends horizontally above the bridge, a bottom below the bridge and sides which connect the top and bottom of the frame to one another. The top and bottom members of the frame are known in this art as the upper and lower crossheads, respectively, while the sides are commonly referred to as the columns or tie-rods of the frame.

So-called return cylinders stand on the bridge and support the upper crosshead of the frame, providing a clearance between the upper crosshead and the top of the bridge. During a certain position of the operating cycle, pressure in the return cylinders is reduced, and the pistons or rams of the return cylinders are lowered, resulting in the workpiece being abutted between the bridge and the upper crosshead of the frame. The metallic workpiece is located on a first die half which is located on the bridge while a facing die half which is secured to the top of the frame projects from above. Although the entire weight of the frame, weighing as much as several hundred tons can be applied to the workpiece, the forging operation under certain circumstances, may require much larger forging forces. The required forces may reach, depending on the press rating, several hundred kilotons; moreover, the forces must always be applied under controlled conditions.

Therefore, the forging press pressures are generated by a plurality of main cylinders which are disposed beneath the bridge, on the lower crosshead of the frame. When the main cylinders are operated their pistons extend, and being braced against the bottom of the bridge, the frame is pushed downwardly with great force. Consequently, the metallic workpiece located above the bridge is forced to assume a shape of the die cavity.

Conventionally, the stationary bridge of the forging press is located at about ground level. The portions of the frame which extend below the bridge and the main cylinders are housed in a foundation pit. The main cylinders are quite large and heavy. In a forging press of the type to which the present invention is directed, there are typically as many as six, nine, or more such cylinders each weighing in excess of 100 tons, sometimes more than 350 tons. To save space, the cylinders are arranged in a tight configuration in the foundation pit.

A severe shortcoming of the above described forging press arrangement consists in that whenever any one of the main cylinders requires repair or replacement, the task of removing such main cylinder from the foundation pit involves an operation which, experience has shown, consumes many days, resulting in a shutdown of the forging press for an unduly long period.

SUMMARY OF THE INVENTION

-Accordingly, it is an object of the present invention to provide a pull-down forging press arrangement which facilitates removal of the large main hydraulic cylinders from the foundation pit of the forging press.

It is another object of the present invention to provide permanent facilities in the foundation pit of the forging press which will substantially shorten the time required for removing a hydraulic cylinder from the pit and, at the end of the servicing, putting it back in place.

The foregoing and other objects of the present invention are realized with a tunnel that is provided in the foundation pit next to the large main hydraulic cylinders. The height of the frame is usually so arranged that a cylinder bed on the lower crosshead assembly upon which the large cylinders rest can be made level with the floor of the tunnel. A heavy steel plate is laid down on the floor of the tunnel, the steel plate having a smooth surface over which the cylinders each of which weighs many tons (100 tons or even more than 350), can slide. Hydraulic jacks anchored to the floor or the walls of the tunnels are attached to the main cylinders to move them along the floor. Preferably, guide rails on the floor help the cylinders to remain on a straight course while being pushed or pulled over the tunnel floor. A vertical shaft extending from the tunnel to a building floor above is large enough so that with the hoisting means the main cylinders can be lifted from the foundation pit to the building floor.

The tunnel will be sufficiently long and wide to permit temporary storage of cylinders which otherwise block the path of a cylinder that is to be removed. It has been calculated that two strategically located hydraulic jacks, each of about 50 ton capacity, will be necessary and adequate to pull or push each cylinder through the tunnel.

Other features and advantages of the present invention will become apparent from the following description of a preferred embodiment thereof which is described below in relation to the appended drawings.

DETAILED DESCRIPTION OF A PREFERRED EMBODIMENT

Figure 1:
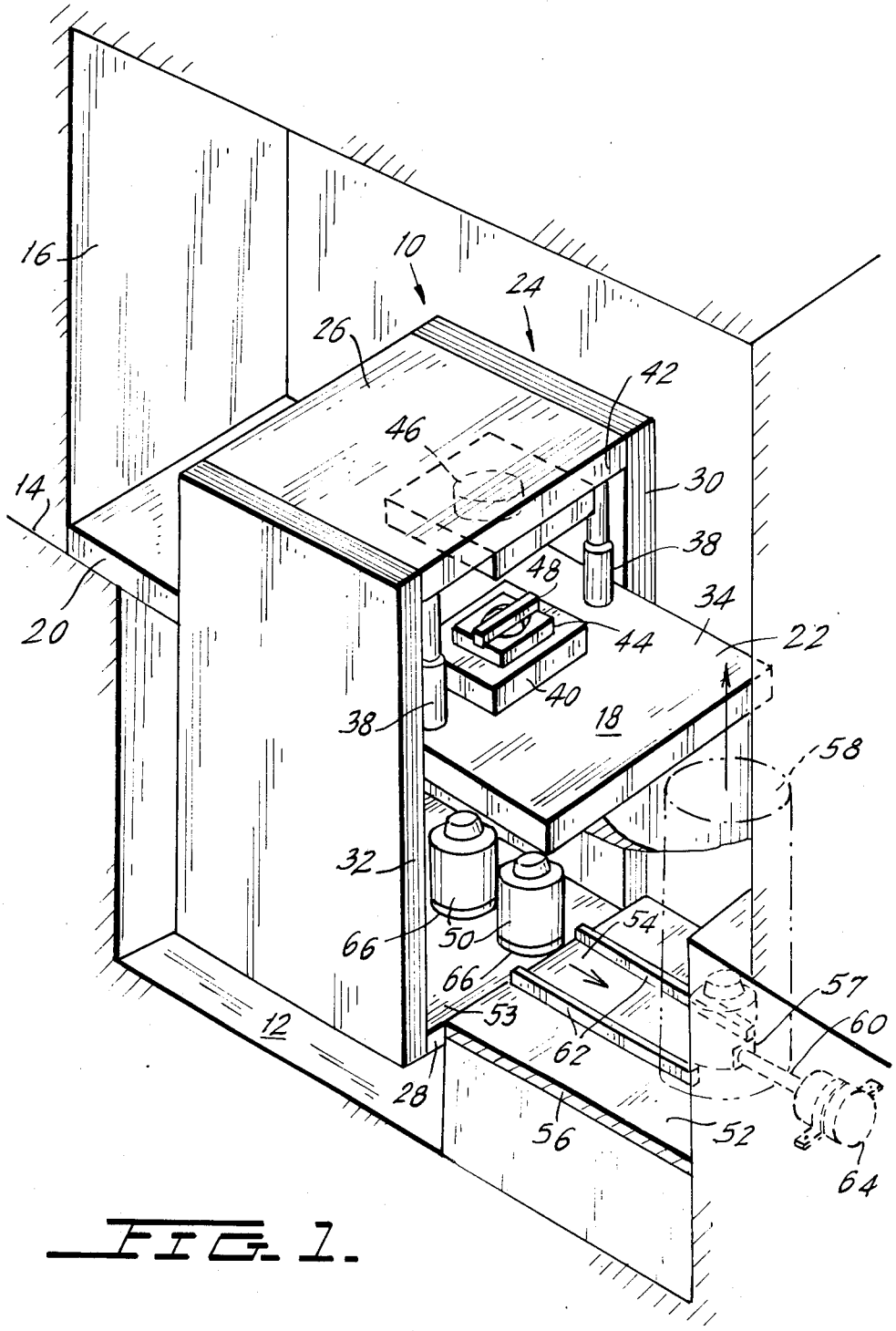
FIG. 1 is a schematic perspective illustrating a pull-down press including a tunnel and a vertical shaft through which main cylinders of the forging press can be removed from its foundation pit.

It should be noted at the outset that the pull-down forging press 10 which is illustrated in FIG. 1 is merely a schematic presented for facilitating understanding of the concepts and the general environment of the present invention and does not correspond to an actual embodiment of a pull-down forging press.

Thus, the forging press 10 in FIG. 1 is housed in a building 11 for a forging press having a foundation pit 12 below ground level 14 and a main building 16 above ground level. A bridge 18 extends across foundation pit 12 and is supported at its ends 20 and 22 at about ground level 14.

A frame 24 surrounds bridge 18 and includes an upper crosshead assembly 26 above the bridge, a lower crosshead assembly 28 below bridge 18 and first and second tie-rod assemblies 30 and 32 for connecting the upper and lower crossheads 26 and 28 to one another to complete the frame structure. Frame 24 is movable up and down in a manner which permits upper crosshead 26 to be raised and lowered with respect to the top 34 of bridge 18.

A plurality of return cylinders 38 extend between the top 34 of bridge 18 and upper crosshead assembly 26 for supporting upper crosshead assembly 26 above a workpiece platen 40 which is located on bridge 18. An upper platen 42 is secured to upper crosshead assembly 26 and projects above workpiece platen 40. Workpiece platen 40 and upper platen 42 support, respectively, an upward facing bottom die 44 and a downward facing top die half 46. A metallic workpiece 48 is located between dies 44 and 46 to be compressed and shaped therebetween to form an end product having an intended shape and characteristics.

A plurality of main cylinders 50 located below bridge 18 and extending between lower crosshead assembly 28 and the bottom of bridge 18 are actuated to push the frame downwadly with great force thereby squeezing and forging the metallic or composite workpiece between dies 44 and 46.

When the need arises to remove any of main cylinders 50 from the foundation pit 12, frame 24 is lowered until cylinder bed 53 is level with floor 52 of tunnel 54. The floor 52 of tunnel 54 is sturdy enough to support main cylinders 50, each of which may weigh several hundred tons. To facilitate sliding of cylinders 50 on the floor of tunnel 54, the floor may be comprised of a heavy steel plate 56.

A vertical shaft 58 communicating with tunnel 54 at the end 60 thereof enables main cylinders 50 to be lifted by an overhead crane (not shown) of the press building to an area of the press building where it can be repaired or serviced. To maintain main cylinders 50 on a straight course as it is being moved under vertical shaft 58, floor 52 of tunnel 54 may be provided with guide rails 62 between which the movement of cylinders 50 is constrained. Cylinders 50 are pushed or pulled using hydraulic jacks 64 attached to the floor 52 or side walls of tunnel 54. Jacks 64 is coupled or connected to cylinders 50 by or through an attachment means 57 which can take the form of any of several connection means which are well known to mechanical designers. It has been calculated that two hydraulic jacks at about 50 tons rating each would be capable of moving any one of main cylinders 50. To facilitate sliding of cylinders 50 over floor 52, a steel plate ring 66 may be installed under a given main cylinder 50 which is to be moved, the bottom of ring 66 having a low friction surface to facilitate sliding of cylinder 50 over floor 52 of tunnel 54.

Figure 2:
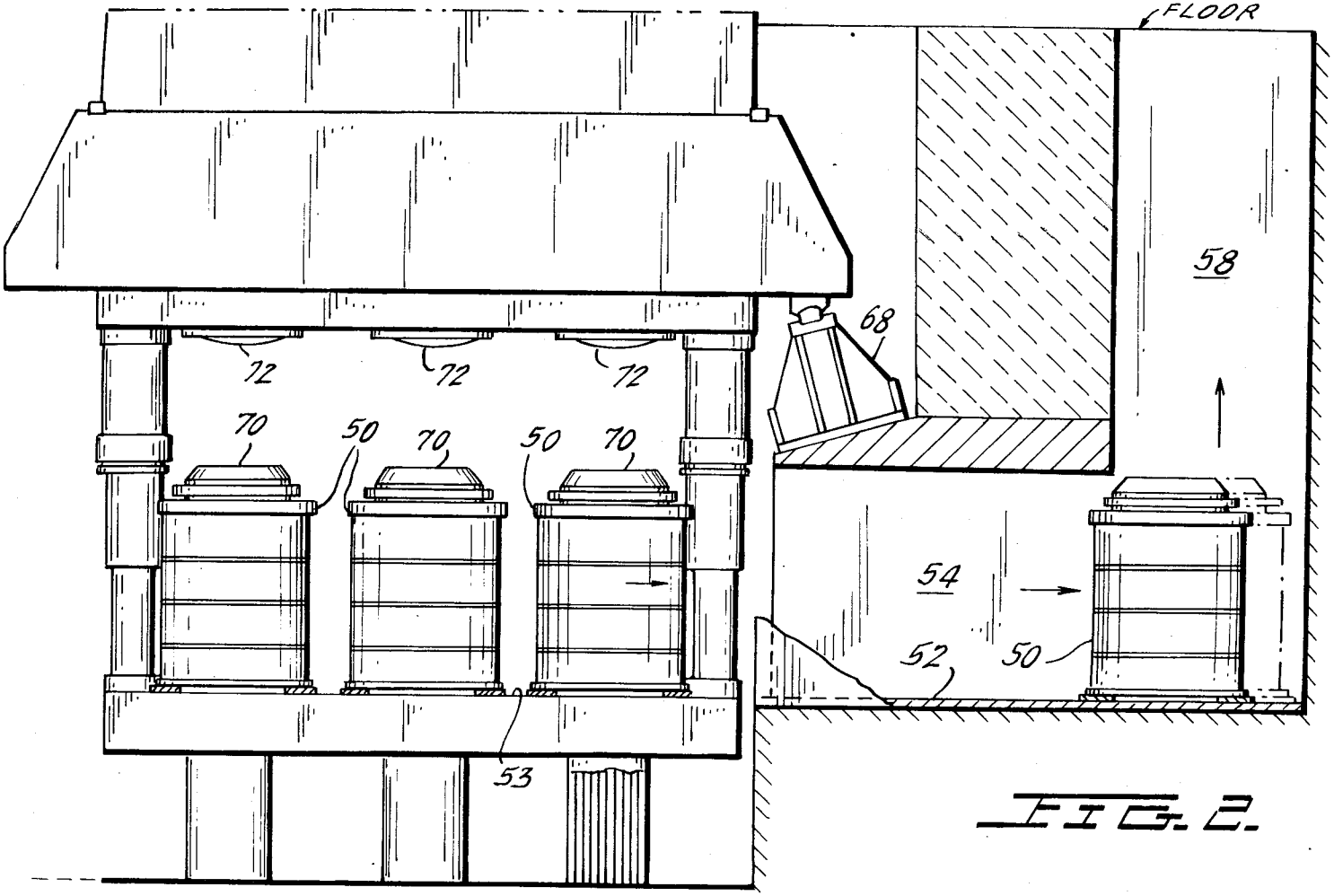
FIG. 2 is a cross-section through a pull-down forging press which is provided with the tunnel of the present invention.

In FIG. 2, which is more representative of an actual pull-down forging press, are illustrated bridge 18 which is supported along one side thereof by anchor 68 and main cylinders 50 having rams or pistons 70, usually in contact with cylinder braces 72, but now in the cylinder body, so that the cylinders are in condition for being removed. Anchor arrangement 68 is repeated on the left side of bridge 18, although not shown in FIG. 2. Tunnel 54 in FIG. 2 is shown with one main cylinder 50 in position under the vertical shaft. It has been calculated that for very powerful forging presses of several hundred kiloton rating a tunnel measuring about 14 feet in width about 26 feet in height will be well suited for the purposes of the present invention. Other elements in the press of FIG. 2 which correspond to similar elements in FIG. 1 are denoted by identical reference numerals.

Although the present invention has been described above in relation to a preferred embodiment thereof, many other variations and modifications will now become apparent to those skilled in the art. It is therefore preferred that the present invention be limited not by the specific embodiment disclosed herein but only by the appended claims.

What is claimed is:

1. A forging press arrangement, comprising:

a foundation pit for a forging press;

a stationary bridge extending above said foundation pit of said forging press;

a pull-down forging press frame cooperating with said bridge, said frame having a horizontally extending lower crosshead below the bridge and in the foundation pit;

a plurality of main cylinder means supported on said lower crosshead and braced against an underside of said bridge, said cylinder means being operable to push said frame downwardly to forge a metallic workpiece located above said bridge;

vertically disposed tunnel means in the foundation pit, said tunnel means being laterally displaced with respect to said forging press frame and being separate from said foundation pit, a horizontal tunnel connecting said foundation pit and said vertically extending tunnel means, said tunnel means having a cross-sectional area which is larger than a maximum cross-sectional area of said cylinder means and being so disposed relative to said lower crosshead to enable any one of said cylinder means to be removable from its location on said lower crosshead to another location away from said lower crosshead and out of said foundation pit through said vertically extending tunnel means; and means for moving any one of said main cylinder means through said horizontal tunnel into said vertically extending tunnel means for enabling said cylinder means to be lifted upwardly through said vertical tunnel means.

2. A forging press arrangement as in claim 1 wherein said horizontal tunnel comprises a smooth sliding floor surface over which said cylinder means are slideable.

3. A forging press arrangement as in claim 2 further comprising at least one hydraulic jack disposed in said foundation pit and braced therein to enable said at least one hydraulic jack to move any one of said cylinder means in said horizontally extending tunnel to a position under said vertical shaft.

4. A forging press arrangement as in claim 3 wherein said horizontally extending tunnel and said vertical shaft are sized to move any one of said cylinder means past another one of said cylinder means which are already located in said horizontally extending tunnel.

5. A forging press arrangement as in claim 1 wherein the weight of any one of said cylinder means is in the range of several hundred tons.

6. The forging press arrangement as in claim 1 which further comprises guide rails located on said floor of said horizontally extending tunnel for constraining the movement of said cylinder means over said floor of said horizontally extending tunnel to follow a predetermined path.

* * * * *